US005553419A

United States Patent [19]

Jenkins, II

[11] Patent Number: 5,553,419

[45] Date of Patent: Sep. 10, 1996

[54] DOOR THRESHOLD ASSEMBLY

[75] Inventor: Thomas E. Jenkins, II, Laguna Niguel, Calif.

[73] Assignee: Renaissance French Doors & Sash, Inc., Fullerton, Calif.

[21] Appl. No.: 269,188

[22] Filed: Jun. 30, 1994

[51] Int. Cl.[6] ..... E06B 1/70

[52] U.S. Cl. ..... 49/469; 52/204.1

[58] Field of Search ..... 49/504, 467, 468, 49/469, 470, 471; 52/204.1

[56] References Cited

U.S. PATENT DOCUMENTS

| | | | |
|---|---|---|---|
| Re. 17,552 | 1/1930 | Andersen | 52/204.1 |
| 2,728,961 | 1/1956 | Lyon | 49/469 |
| 2,848,766 | 8/1958 | Fulton . | |
| 2,898,642 | 8/1959 | Etling . | |
| 2,909,815 | 10/1959 | Campo . | |
| 3,261,130 | 7/1966 | Lawson . | |
| 4,055,917 | 11/1977 | Coller . | |
| 4,079,550 | 3/1978 | Bursk et al. . | |
| 4,441,277 | 4/1984 | Naylor | 49/467 X |
| 4,447,987 | 5/1984 | Lesosky . | |
| 4,578,905 | 4/1986 | Hout | 49/467 X |
| 4,831,779 | 5/1989 | Kehrli et al. . | |
| 4,875,316 | 10/1989 | Johnston . | |
| 5,010,690 | 4/1991 | Geoffrey . | |
| 5,212,921 | 5/1993 | Unruh . | |
| 5,230,181 | 7/1993 | Geoffrey et al. . | |

FOREIGN PATENT DOCUMENTS

| | | | |
|---|---|---|---|
| 2115138 | 10/1972 | Germany | 49/467 |
| 3527113 | 1/1987 | Germany | 49/467 |

*Primary Examiner*—Jerry Redman

*Attorney, Agent, or Firm*—Harness, Dickey & Pierce, P.L.C.

[57] ABSTRACT

A multipiece construction threshold assembly particularly adapted for use with replacement, exterior swinging, entry doors. A first piece of the assembly being an exterior metal, weather resistant saddle with a front downwardly extending flange, and a rear upwardly extending riser. The front flange extending to provide a weather seal between a foundation support surface and a base plate of the threshold. A second piece being a wooden cap having an exterior face abutting the rear riser of the metal saddle and extending inward toward the interior of the building to provide an aesthetically pleasing appearance.

5 Claims, 4 Drawing Sheets

DOOR THRESHOLD ASSEMBLY

BACKGROUND OF THE INVENTION

1. Technical Field

This invention relates to doors and, more particularly, to door threshold assemblies that resist leakage into the interior of buildings.

2. Discussion

Various door threshold assembly constructions are known in the art. The patent literature includes the following patents: U.S. Pat. Nos. 2,848,766; 2,898,642; 2,909,815; 3,261,130; 4,055,917; 4,079,550; 4,447,987; 4,831,779; 4,875,316; 5,010,690; 5,212,921 and 5,230,181.

Various bumper threshold designs for out-swinging doors are commercially available from various sources such as Combo Aluminum Products. While each of these prior designs purports to have their own set of advantages, still further improvements in the art as to construction, leakage resistance and aesthetics can be made.

The present invention is drawn to improving one or more of these characteristics.

SUMMARY OF THE INVENTION

Pursuant to the teachings of the present invention, a threshold assembly for an exterior swinging door is provided with a two piece construction. A first piece is in the form of an exterior metal, weather resistant saddle having a front downwardly extending flange and a rear upwardly extending riser. The downwardly extending front flange extends beneath the gap between the foundation's upper surface and the lower surface of a baseplate to prevent moisture from entering the building. The exterior face of the riser includes a slot for receiving a bulb-type seal. The interior face of the riser provides an abutment surface for receiving an aesthetically pleasing wooden cap whose upper surface is flush with the upper surface of the riser. Preferably, the front flange of the metal saddle is vertically aligned with the exterior face of the door and the wooden cap blends aesthetically with the door. The threshold assembly finds particular utility in combination with apparatus for replacing entrance doors to homes.

BRIEF DESCRIPTION OF THE DRAWINGS

The various advantages of the present invention will become apparent to those skilled in the art after reading the following specification and by reference to the drawings in which.

DESCRIPTION OF THE PREFERRED EMBODIMENT

Figure 1:
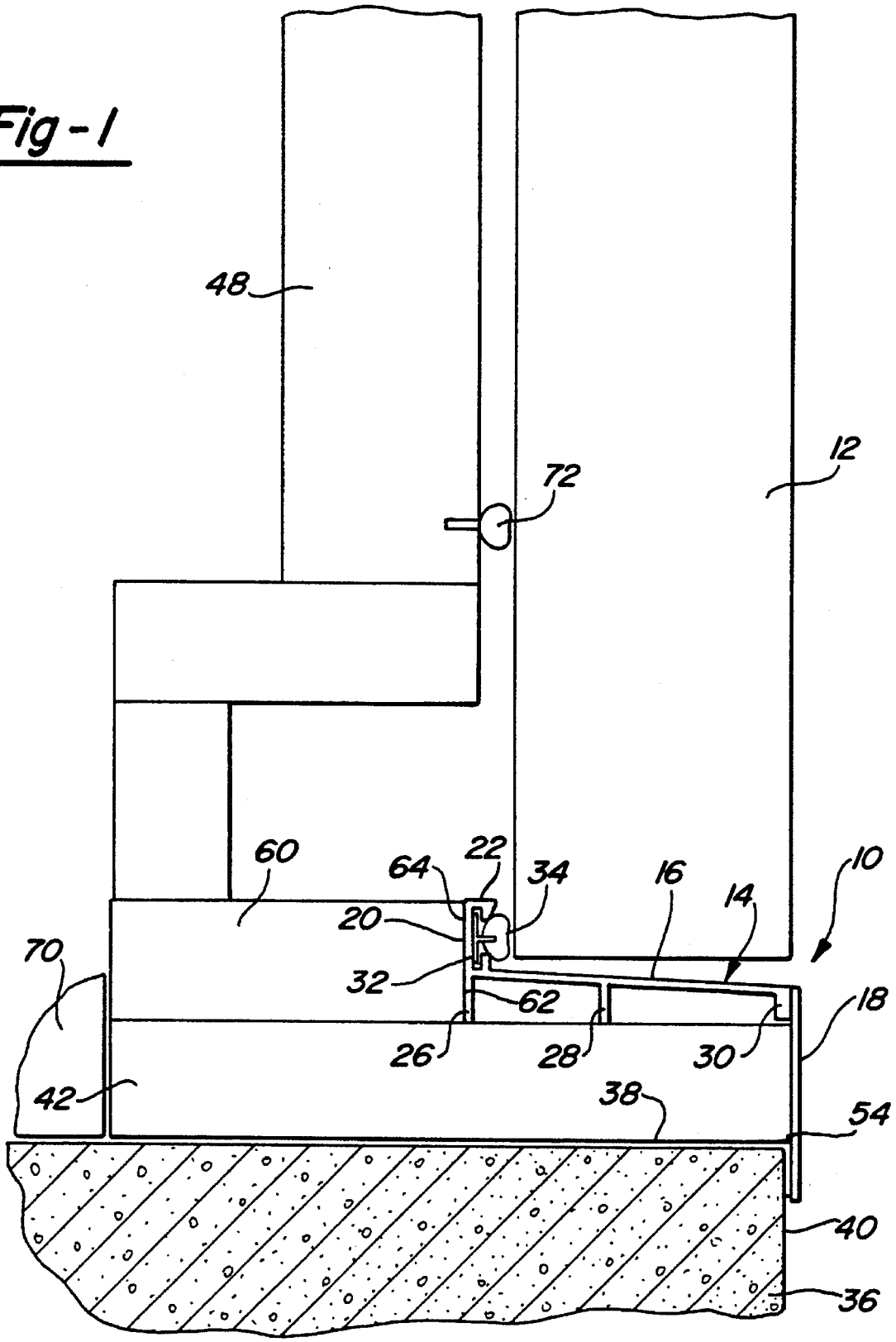
FIG. 1 is a partial sectional end view of a door threshold made in accordance with the teachings of this invention, installed in connection with an exterior swinging door with sidelites.

Referring now to the drawings, threshold assembly 10 is shown installed with an exterior swinging door 12, preferably made of wood. Threshold 10 includes an aluminum extruded saddle 14 having a forwardly sloping tread member 16 terminating at an exterior end in a downwardly extending front flange 18. The rear, or interior, end of tread 16 joins with a vertically extending riser 20 having a horizontally extending top shelf 22 which cooperates with the exterior face of the riser 20 to form a T-slot 24. A plurality of legs 26 and 28, as well as reinforcing fillet 30 round out the construction of the saddle 14.

Slot 24 receives a T-shaped stem 32 of a seal having an exteriorly facing flexible bulb 34.

The threshold assembly 10 finds particular utility in connection with replacement door installations of the general type illustrated in the drawings. While not limited to residential homes, this invention is well suited for replacing doors in homes which are built on a foundation such as a concrete slab. However, the invention is also useful in other types of home constructions in which wood or other material provides the foundation upon which the door threshold is installed. For simplicities' sake, this structure, be it wood or concrete, shall be referred to as the foundation support 36. Foundation support 36 has an upper major surface 38 and an exterior surface 40 which is exposed to the outside environment. The threshold assembly 10 rests either directly or indirectly on the foundation support surface 38. As shown in the drawings, a plywood baseplate 42 is often employed to raise the threshold 10 to a desired level depending upon the interior flooring used in the home.

Figure 2A:
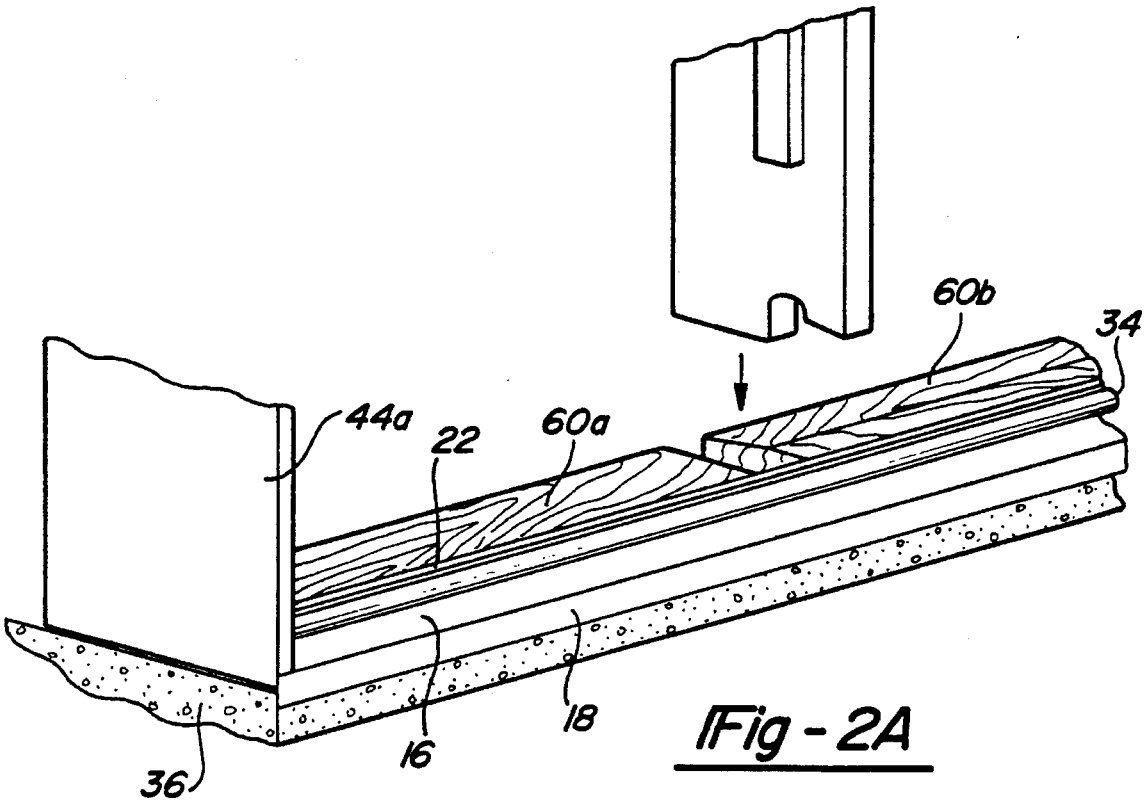
FIG. 2(A–B) are exploded perspective views of portions of the installation shown in FIG. 2, as viewed from the exterior.
Figure 2B:
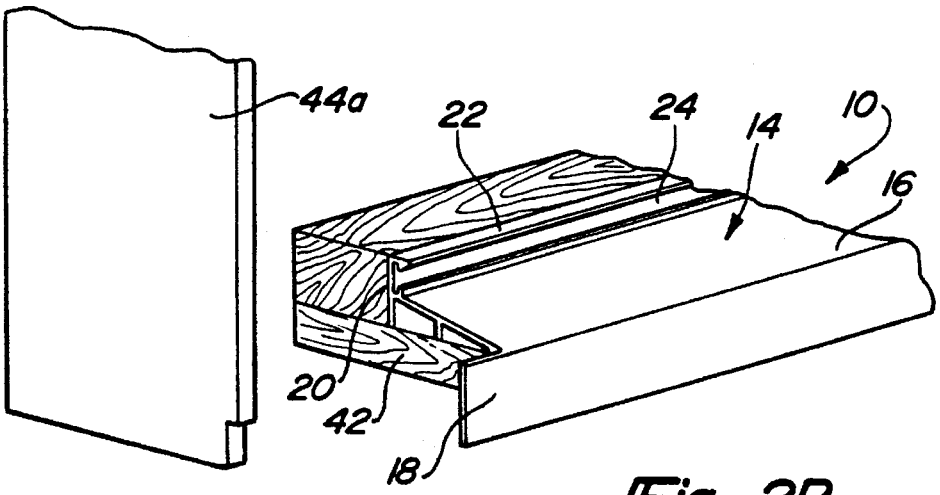
Figure 3:
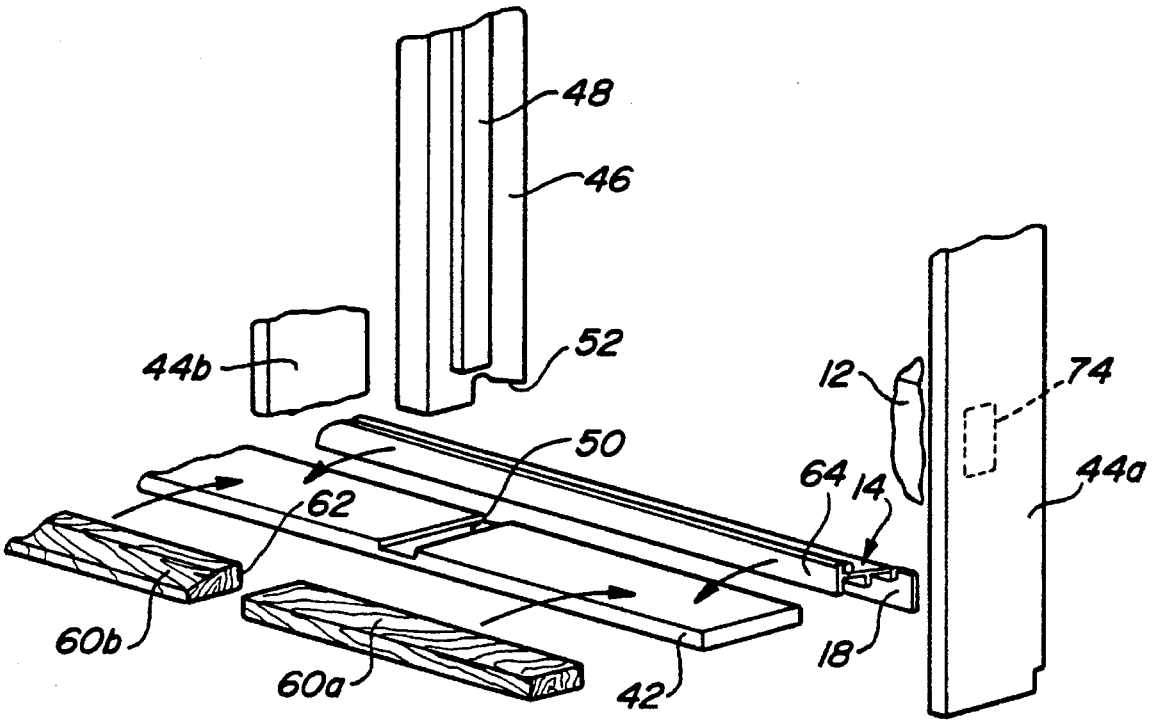
FIG. 3 is an exploded perspective view, similar to FIG. 2, but viewed from the interior.
Figure 4:
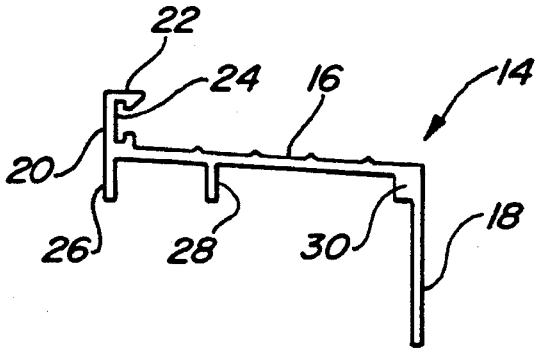
FIG. 4 is an end view of the metal saddle.
Figure 5:
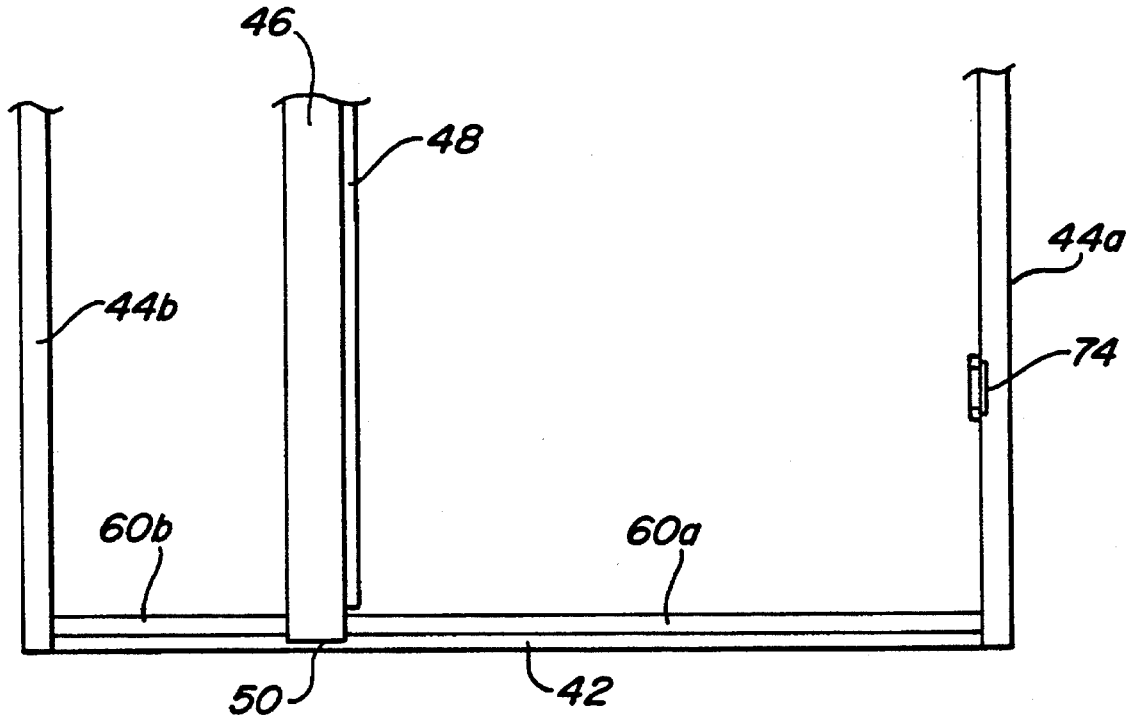
FIG. 5 is a rear elevational view of the door threshold assembly.

With special reference to FIGS. 2 and 3, the installation of the threshold assembly 10 with an exterior swinging door with sidelites is shown. The door installation includes a pair of jambs 44*a*, 44*b* and a post 46 with a door stop 48 thereon having weather seal 72 thereon. The door is connected to jamb 44*a* by hinge 74. The baseplate 42 includes a dado slot 50 (FIG. 3) for receiving the bottom surface of post 46. Bottom surface of post 46 includes a cutout 52 such that the saddle 14 can extend continuously between jamb 44*a*, underneath post 46 to the opposite door jamb (44*b*).

As can be appreciated, the front flange 18 of the saddle extends downwardly a sufficient distance to cover the gap 56 (FIG. 1) between the foundation support surface 38 and the baseplate 42. Thus, the saddle 18 is effectively "self flashing", i.e., it provides a weather seal for preventing rain or other moisture from being blown into the interior of the home. This is accomplished without the necessity of adding glue or other adhesives which would complicate the installation procedure.

The saddle is secured to the baseplate 42 by way of suitable fasteners such as screws (not shown).

In accordance with the teachings of this invention, the interior of the threshold assembly 10 is provided with an aesthetically pleasing wooden cap which is generally designated by the numeral 60. The cap 60 is preferably made of the type of wood that compliments the interior of the home such as oak, pine or the like which can be stained to blend with the door 12 as desired by the home owner. In FIGS. 2 and 3, the cap is shown in two pieces 60*a* and 60*b* to accommodate the dividing post 46. As can be seen most clearly in FIGS. 1 and 2(A), the exterior face 62 of the wooden cap 60 abuts the interior face 64 of the riser 20 of the metal threshold 14. Similarly, top surface 66 of cap 60 is essentially flush with riser shelf 22. The width of cap 60 is about the same as the width of the saddle 14 whose flange 18 is substantially vertically aligned with the exterior face of door 12.

The metal saddle 14 cooperates with the wooden interior cap 60 to provide a variety of benefits. For example, the saddle 14 is exposed to the exterior environment but, because it is made of metal, it is resistant to rotting and other decay. The downwardly extending front flange 18, as noted above, prevents moisture from entering the home through the gap 54. The weather seal 34, likewise, provides a weather tight construction. On the other hand, the wooden cap, which is seen from the interior of the home (the metal saddle 14 being blocked from view when the door is shut), provides a good looking appearance that can be coordinated with the wooden door which is used in the installation. If desired, molding 70 can be used to hide the interior gap between the baseplate 42 and the cap 60 to even further increase the pleasing structure.

As noted above, the invention has particular applicability to replacing residential entry doors. By replacing normally interiorly swinging doors with the present invention that incorporates an exterior swinging door, the interior entryway of the home becomes less crowed when the door is opened. In addition, exterior swinging doors tend to be more difficult to force open thereby increasing security of the home. Unfortunately, exterior swinging doors may create sealing problems which are not encountered by interior swinging doors but these problems have been obviated by the present invention.

These and other benefits of the present invention should now be apparent to those skilled in the art. It should, however, be understood, that while this invention has been described in connection with a particular example, it is not so limited since the saddled practitioner will realize that various modifications of the preferred embodiment can be made without departing from the spirit and scope of the invention.

What is claimed is:

1. A threshold assembly for an exterior swinging door which is installed in a building having a foundation support, said threshold assembly comprising:

a metal saddle having a tread with an interior end and an exterior end, the exterior end having a down turned flange connected thereto, the interior end of the tread having a vertical riser connected thereto, an exterior face of the riser having a slot therein, said saddle being mounted on a top surface of the foundation support adjacent an end surface which is exposed to an exterior environment, said downturned flange extending beyond the top surface of the foundation support to cover any gaps between the saddle and the foundation support surface thereby preventing moisture from entering an interior of the building;

a cap having an exterior side abutting an interior facing side of the riser, said cap having a top surface essentially flush with a top surface of the riser and extending inwardly toward the interior of the building to thereby provide an aesthetically pleasing appearance that blends with the material from which the door is made; and sealing means in the slot of the riser which abuts a lower interior portion of the door to prevent moisture from entering the interior of the building.

2. The threshold assembly of claim 1 wherein the downturned flange of the saddle is substantially aligned with an exterior surface of the door.

3. The threshold assembly of claim 2 wherein the cap is wooden and has essentially the same width as the saddle.

4. The threshold assembly of claim 3 which further comprises:

a wooden baseplate on the foundation surface which supports the saddle and cap, the downturned flange extending beneath a lower surface of the baseplate to cover any gaps between the lower surface of the baseplate and an upper surface of the foundation support surface.

5. Apparatus for replacing an entrance door in a building having a foundation support surface, said apparatus comprising:

an exteriorly swinging wooden door hinged at one edge to one of a pair of jambs;

a baseplate extending between the jambs and having an interior side and an exterior side;

an intermediate post located between the jambs, said post having a lower surface mounted to the baseplate, said lower surface also having a cutout portion therein and a vertically extending stop member for receiving an opposite edge of the door;

an aluminum extruded saddle having a tread surface with an interior end and an exterior end, the exterior end including a downturned flange which extends beyond the interface between the baseplate and the foundation support surface to cover any gaps between the saddle and the foundation support surface, the interior end of the tread member including a vertically extending riser located approximately midway between the interior and exterior sides of the baseplate, an upper shelf of the riser cooperating with an exterior face of the riser to form a T-shaped slot therein, said saddle extending laterally between the jambs with the riser and tread passing through the cut out portion in the post;

a seal having a T-shaped stem captured by the T-shaped slot in the riser, said slot further including a bulb for engaging lower interior portions of the door to prevent moisture from entering an interior of the building;

a multi-piece wooden cap on the baseplate, said cap having an exterior side abutting an interior face of the riser, said cap having a top surface essentially flush with the upper shelf of the riser and extending inwardly to cover the baseplate, said cap being divided into multiple cap members, a first cap member extending between one of the jambs and the post, with a second cap member extending between the post and the other jam; and molding on interior end faces of the baseplate and the cap members covering any gaps therebetween.

* * * * *